United States Patent [19]

Allan

[11] 4,186,810

[45] Feb. 5, 1980

[54] FLUID OPERATED UNDERCUTTER

[75] Inventor: David T. Allan, 9 Broomhill Dr., Rutherglen, Glasgow, Scotland, G73 3 QH

[73] Assignees: John MacDonald & Company (Pneumatic Tools) Limited; David Thomson Allan, both of Glascow, Scotland

[21] Appl. No.: 812,620

[22] Filed: Jul. 5, 1977

[30] Foreign Application Priority Data

Jul. 6, 1976 [GB] United Kingdom ..... 28015/76

[51] Int. Cl.[2] ..... E21B 1/06

[52] U.S. Cl. ..... 175/96; 175/267

[58] Field of Search ..... 175/92, 96, 77, 53, 175/267, 269, 40, 73, 74, 61; 292/62; 166/55.7, 55.8

[56] References Cited

U.S. PATENT DOCUMENTS

| | | | |
|---|---|---|---|
| 530,512 | 12/1894 | Elliott et al. | 175/267 X |
| 789,867 | 5/1905 | McCallum | 166/55.8 |
| 1,750,953 | 3/1930 | Boynton | 175/267 |
| 1,777,713 | 10/1930 | Braden | 166/55.8 |
| 2,299,718 | 10/1942 | Florez | 175/267 X |
| 2,595,126 | 4/1952 | Causey | 175/96 |
| 3,316,970 | 5/1967 | Huitt et al. | 166/55.7 |
| 3,361,219 | 1/1968 | Sears | 173/64 |
| 3,554,302 | 1/1971 | Adkins et al. | 175/267 X |
| 3,556,233 | 1/1971 | Gilreath et al. | 175/267 |
| 3,583,501 | 6/1971 | Aalund | 175/96 |
| 3,817,336 | 6/1974 | Sears | 175/61 |

*Primary Examiner*—James A. Leppink
*Assistant Examiner*—Richard E. Fabreau
*Attorney, Agent, or Firm*—Bertram Frank

[57] ABSTRACT

An undercutter comprising a slotted tubular body in which is mounted an extendable and retractable cutting head for undercutting a bore into which the tubular body is positioned and rotated. The cutting head includes a fluid-operated reciprocally movable piston, the reciprocating rate of which is determined by an annular liner positioned between the outer wall of the piston body and the inner wall of the piston cavity.

17 Claims, 5 Drawing Figures

FLUID OPERATED UNDERCUTTER

This invention relates to undercutters of the type described in the Applicant's co-pending Patent Application No. 53060/75 filed in England.

In the aforementioned Application there is described an undercutter having cutting heads adapted to rotate within a parallel-sided hole so as to undercut the wall thereof. The undercut portion improves the grip of a fixing device or bolt secured in the hole either mechanically or with grout and/or an epoxy bonding agent. The undercutter described therein is relatively complex and expensive to produce. Moreover, in Application No. 53060/75 an embodiment is described for forming "mushroom" undercut portions in the wall, i.e. grooves which are downwardly divergent so that a mushroom head of grout or the like will be provided to retain a fixing bolt in the hole. However, this involves individual adjustment of the piston and cylinder units on the cutting head.

An object of the present invention is to provide an undercutter which is relatively simple and inexpensive to produce.

A further object of the present invention is to provide an improved undercutter for providing mushroom undercut portions.

Furthermore, in the undercutters described in the aforesaid Application the depth of the undercut portions being formed is effectively limited to the stroke of the percussive piston.

According to the present invention there is provided an undercutter for undercutting the wall of a substantially parallel sided hole and comprising a substantially tubular body adapted to pass into said hole, means on the body for setting the length of said body contained in the hole and a fluid-operated cutting head on the body and adapted to be rotated within the hole so as to form an undercut portion therein.

Preferably, said cutting head is of the fluid-operated percussive piston type.

Preferably also, said cutting head has one cutting tool fitted thereto the shape of which depends on the profile of the undercut to be formed.

Preferably also, the cutting head is rotated manually by means of a handle formed on said body at the end remote from said cutting head.

Further according to the present invention there is provided an undercutter comprising a substantially tubular body adapted to pass into a parallel-sided hole, a cutting head mounted on said body and driving means for operating said cutting head, and in which the cutting head is movable on said body so as to extend the cutting field thereof.

Preferably, the cutting head is pivotally connected to the body and activating means is provided to pivot the head during cutting.

Alternatively, the cutting head may be connected to the body through a slide and the cutting head is movable along said slide by activating means.

The fluid may be compressed air and it may be fed to the cutting head through said body having been fed to the body through a rotary joint.

Moreover, more than one cutting tool may be provided on the cutting head.

Embodiments of the present invention will now be described, by way of example, with reference to the accompanying drawings, in which.

Figure 1:
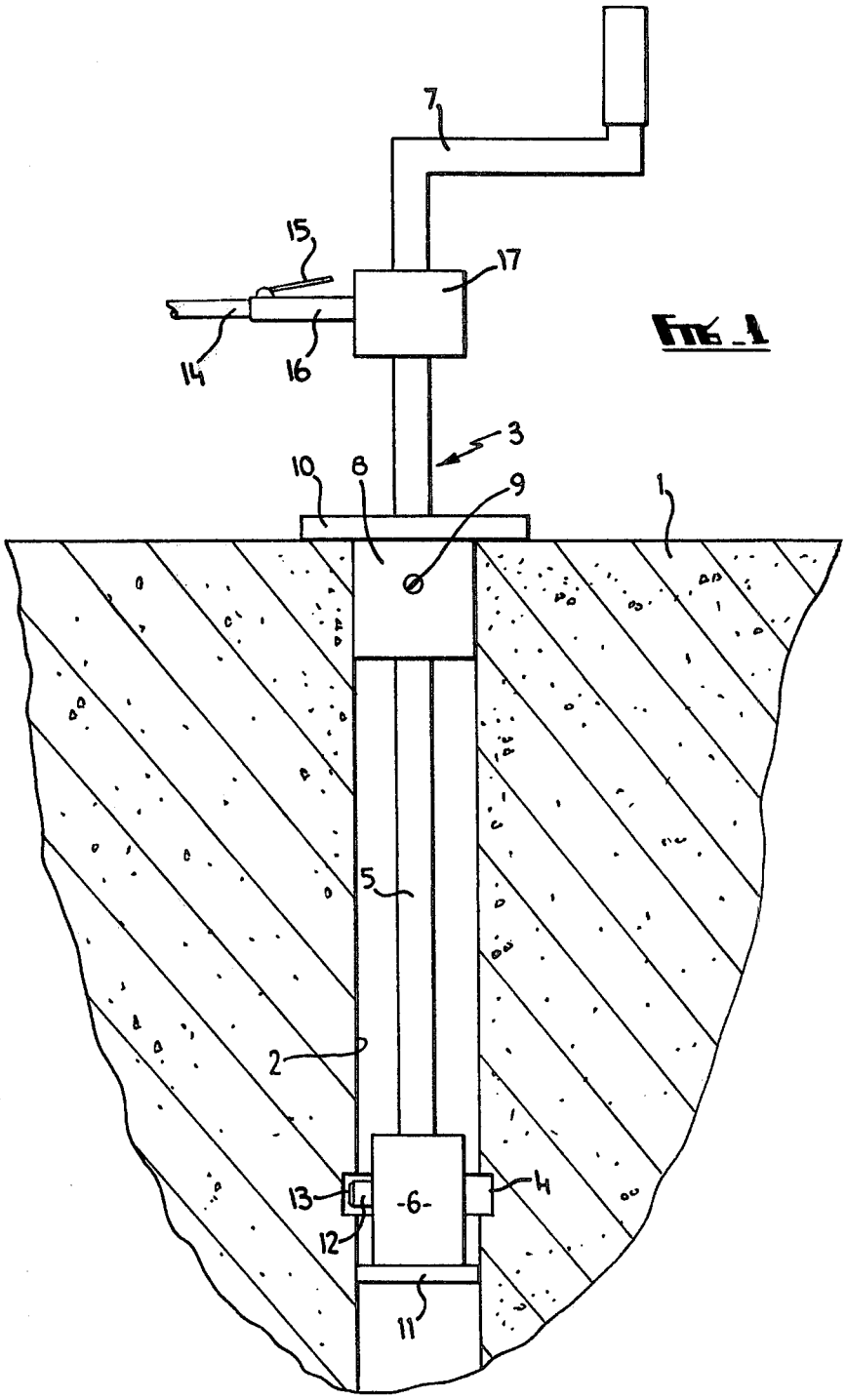
FIG. 1 is a sectional view through a parallel sided hole in a block of concrete and showing an undercutter according to the invention in the hole.

Referring to the drawings a concrete block 1 has a parallel sided hole 2 formed therein and in which a fixing bolt or device is to be secured. In order to obtain maximum grip it is desirable that undercut formations are formed in the wall of the hole, which formations may be in the form of grooves.

An undercutter 3 according to the present invention is provided for cutting one or more grooves 4 in the wall of the hole 2. The undercutter 3 comprises a substantially tubular body portion 5 which extends into the hole and is provided at its bottom end with a cutting head 6 and at its upper end with a handle 7. A depth guide 8 is provided on the body 5 and comprises a collar which is connected to the body by a grub screw 9 and which has a flange 10 adapted to rest on the surface of the block 1, the depth gauge therefore acts as a centralizing member for the body 5. The cutting head 6 is maintained centrally of the hole by a nylon disc 11 attached to its bottom end in any convenient manner.

In the embodiment described with reference to FIG. 1 the cutting head 6 is provided with a single percussion piston 12 which is reciprocable in a liner (not shown) in the body of the cutting head. A tungsten carbide bit 13 is fitted on the piston 12 and is of a shape which will provide the correct formation of undercut in the wall of the hole.

Compressed air is supplied to the cutting head 6 through a line 14 and a snap valve 15 mounted on a hand grip 16. Air passes through the hand grip into the body through a rotary coupling 17 surrounding the body.

In operation, the undercutter is placed in the hole 2 to a depth set by the guide 8. The percussion piston 12 is set in motion by supplying compressed air to the cutting head through the snap valve 15. The operator operates the snap valve 15 while holding the hand grip 16 in one hand and rotates the cutting head with the other by means of the handle 7. The cutting head will therefore cut a groove or other formation in the wall of the hole. In the embodiment shown in FIG. 1 a square groove 4 has been formed, however, by using a different shape of tungsten carbide cutting tool 13 any suitable shape or formation of undercut may be provided, for example, a radiused groove can be formed as shown at 4A in FIG. 2.

The groove may be widened by lifting the undercutter from the hole and re-inserting it with the guide in a slightly different position. Alternatively, more than one groove may be formed in the hole by re-inserting the undercutter with the guide positioned appropriately.

Figure 3:
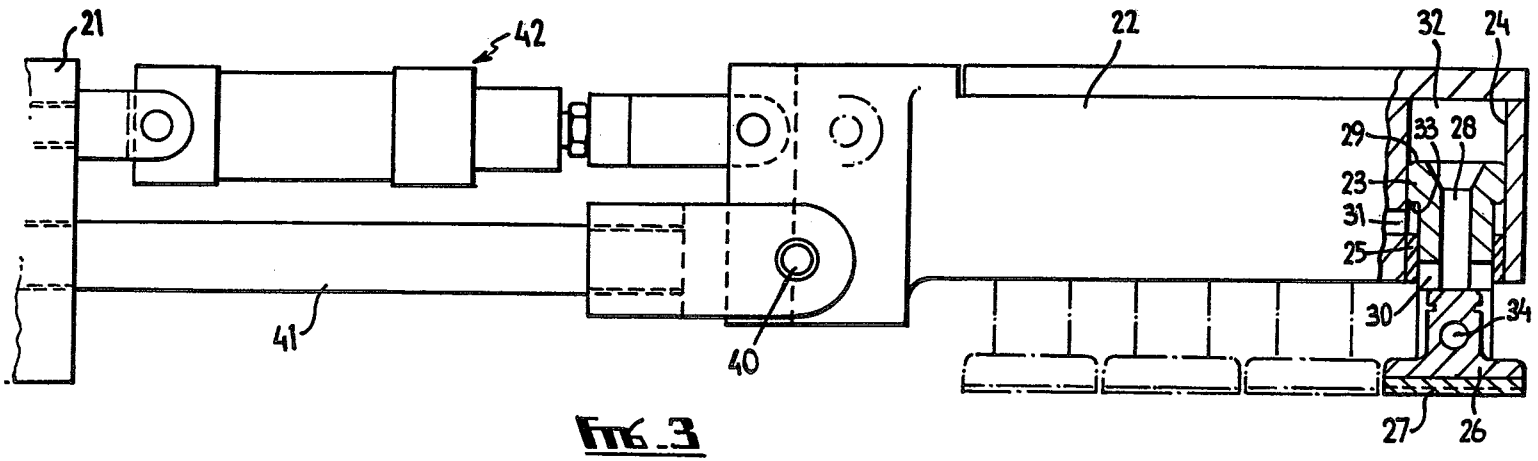
FIG. 3 is a side view (partially sectioned) of part of a further embodiment of an undercutter according to the invention.

In the embodiment shown in FIG. 3 the undercutter comprises a body member 21, only part of which is shown in the drawing. Connected to the body member is a cutting head 22 having four percussive piston units 23, each of which is reciprocable in a bore 24 and a liner 25. Each piston is provided with a cutting tool or bit 26 having tungsten carbide cutting tips 27. A central bore 28 is provided in each piston extending from the head 29 of the piston to a cross port 30 which co-operates with the liner 25 to provide the timing of the reciprocation of the piston. In operation, compressed air is supplied to each percussive piston unit through a port 31, which air operates to lift the piston away from the liner 25 until the cross port 30 passes through the liner and is exposed to the compressed air entering the port 31. At this point compressed air passes through the cross port 30 and the central bore 28 into the chamber 32 formed above the piston. As the top face 29 of the piston has a greater effective area than that of the underface 33 the piston is propelled downwardly towards the liner until the cross port 30 passes through the liner 25 and exhausts the air in the chamber 32 to the atmosphere, whereupon air entering the port 31 acts on the underface 33 and the cycle is repeated. The bit or tool 26 is connected to the piston by means of a spring pin 34 passing through holes in the piston and tool.

The cutting head 22 is pivotally connected to the body 21 through a clevis and pin 40 and air is supplied to the head through a tubular connecting piece 41 which connects the body to the clevis. Actuating means in the form of a double acting piston and cylinder unit 42 is provided for effecting pivoting movement of the cutting head relative to the body, the piston and cylinder unit being operated by compressed air.

Figure 2:
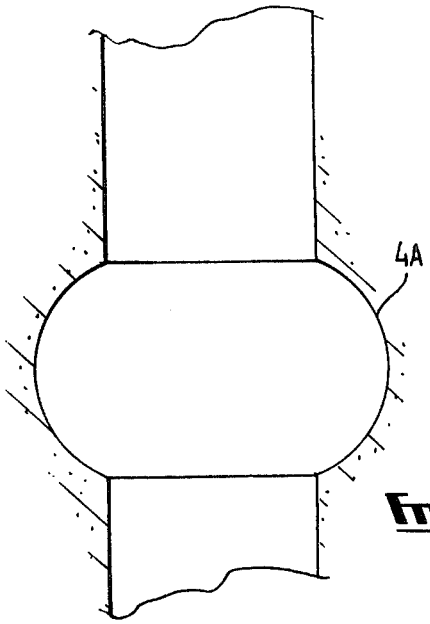
FIG. 2 is a sectional view through part of a hole which has been undercut by an undercutter according to the invention.
Figure 4:
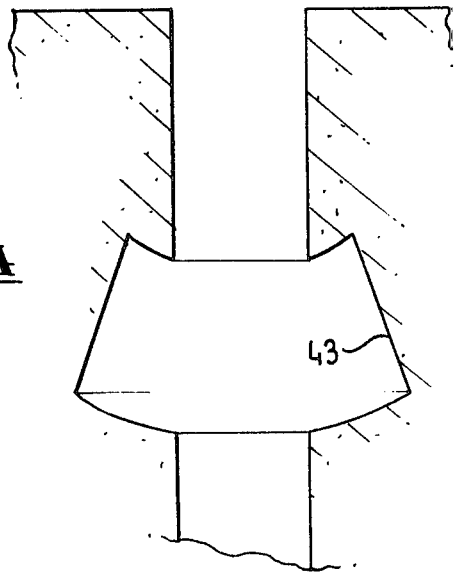
FIG. 4 is a sectional view through a hole provided with a "mushroom" undercut portion.

In operation, the undercutter is inserted in a parallel sided hole to the required depth set by a depth gauge (see FIG. 1 embodiment). Compressed air is supplied to the cutting head in any convenient manner so as to reciprocate the percussive pistons thereby forming an undercut portion in the wall of the hole, which undercut portion is limited in depth to the effective stroke of the pistons. As cutting proceeds the piston and cylinder unit 42 is operated slowly so that the cutting head pivots around the clevis pin 40 thereby forming a "mushroom" undercut portion of the type shown at 43 in FIG. 4. The depth of the undercut portion thus formed exceeds the effective stroke of the percussive pistons.

Figure 5:
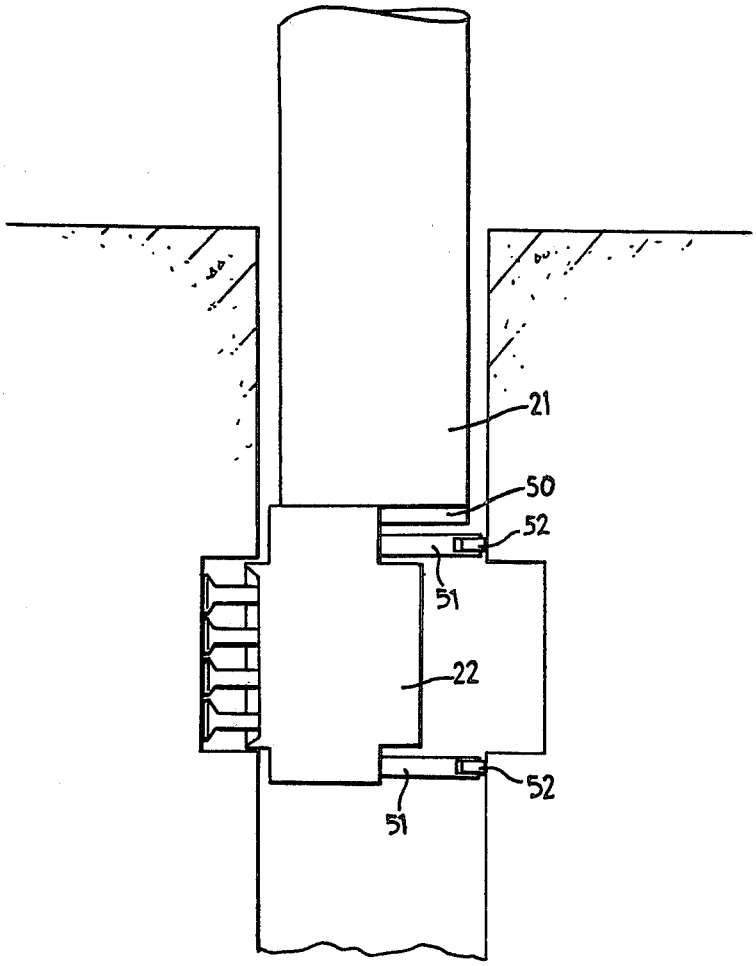
FIG. 5 is a sectional view of a modified undercutter according to the invention.

Referring now to FIG. 5, there is shown an alternative embodiment of the present invention in which the cutting head 22 is mounted on the body 21 through a slide 50 extending, in use, across the hole to be undercut. In this embodiment additional piston and cylinder units 51 are provided at the top and bottom of the cutting head and each piston thereof is provided at its outer end with a guide roller 52 adapted to run around the wall of the hole. Thus, in operation, when it is desired to undercut a hole to a depth beyond the effective stroke of the percussive pistons the piston and cylinder units 51 are progressively operated thereby causing the rollers 52 to press against the wall of the hole so as to push the cutting head 22 along the slide 50 into an eccentric position, as shown in FIG. 5. After cutting the head is spring biased back to a position concentric with the body to allow withdrawal of the undercutter.

In the embodiments described with reference to FIGS. 3 and 5 the cutting head may be rotated in the hole either manually or by means of a fluid-operated drive motor contained within the body 1. Moreover, it will be clear that each of these embodiments allows the cutting field of the cutting head to be extended beyond the effective stroke of the percussive pistons. Furthermore, in each of the embodiments more than one percussive piston is shown. Clearly, however, any number of percussive piston units may be used and different profiles of undercut portions can be formed by suitable selection of the shape of the cutting tool or bit as previously described.

In the embodiment described with reference to FIG. 5 the pistons which move the cutting head along the slide are located outwith the cutting area of the cutting head. In a modified embodiment the pistons 51 can be located within the cutting area of the cutting head and the rollers 52 will therefore run around the newly cut formation. Moreover, it will be appreciated that the cutting head can be moved along the slide in any other convenient manner such as by means of a simple double-acting piston and cylinder.

In circumstances where it is expedient to provide a long uniform undercut portion the cutting tools may be arranged so that their effective cutting areas overlap. In addition a pneumatic cylinder or the like may be provided which reciprocates the cutting head along the hole so as to extend the undercut portion.

In a further modification and in order to provide an undercutter which can accommodate a large range of hole size an extension bar may be provided intermediate the tubular body and the cutting head and extending at right angles to the body. Moreover, it has been found advantageous to provide a rotatable disc on the cutting head which rotates on an axis concentric with the hole being undercut. Such a disc acts as a guide and a support for the cutting head.

What we claim is:

1. An undercutter for undercutting the wall of a substantially parallel sided hole and comprising a substantially tubular body having a lesser diameter than the diameter of said hole for positioning into said hole, means mounted on the body for setting the length of said body contained in the hole, and a fluid operated reciprocating cutting head pivotally mounted on the body to be rotated within the hole so as to form an undercut portion therein.

2. An undercutter as claimed in claim 1, in which said cutting head is of the fluid-operated percussive piston type.

3. An undercutter as claimed in claim 1 or 2, in which said cutting head has one cutting tool fitted thereto the shape of which depends on the profile of the undercut to be formed.

4. An undercutter as claimed in claim 3, in which the cutting head includes a handle connected to said tubular body for rotating said cutting head manually from the end remote from said cutting head.

5. An undercutter as claimed in claim 1, further comprising driving means for operating said cutting head; and wherein said cutting head is movable on said tubular body so as to extend the cutting field thereof.

6. An undercutter as claimed in claim 5, and further comprising activating means for moving said cutting head during cutting.

7. An undercutter as claimed in claim 5 in which the fluid is compressed air which is fed to the pivotally mounted cutting head through said tubular body.

8. An undercutter as claimed in claim 7, in which said cutting head includes more than one cutting tool.

9. An undercutter for undercutting the wall of a substantially parallel-sided hole and comprising a substantially tubular body adapted to pass into said hole, means on the body for setting the length of said body contained in the hole and a fluid-operated cutting head on the body and adapted to be rotated within the hole so as to form an undercut portion therein; in which said cutting head is of the fluid-operated percussive piston type; in which said cutting head has one cutting tool fitted thereto the shape of which depends on the profile of the undercut to be formed; and in which said body includes a manually operable handle at the end remote from said cutting head by means of which said cutting head can be rotated.

10. An undercutter comprising a substantially tubular body adapted to pass into a parallel-sided hole of predetermined diameter, a cutting head mounted on said body, said cutting head including one or more fluid-operated percussive pistons and means for rotating said cutting head around the axis of said body, a cutting tool secured to each percussive piston, and fluid operated cutting head moving means adapted to move said head away from said axis so as to extend the radius of the cutting field of the head beyond said diameter of said hole.

11. An undercutter as claimed in claim 10, in which the cutting head is pivotally connected to the body and said moving means is operative for pivoting said cutting head during cutting to change the inclination of the working stroke of said cutting tool relative to said axis.

12. An undercutter as claimed in claim 10; further comprising a slide mounting said cutting head on said tubular body for reciprocal movement relative thereto.

13. An undercutter as claimed in claim 10, in which said cutting head is pivotally connected to said tubular body and in which the fluid is compressed air which is fed through said body into the cutting head.

14. An undercutter as claimed in claim 13, in which the cutting head comprises a plurality of cutting tools extendable and retractable from said tubular body.

15. An undercutter according to claim 10, wherein said piston is mounted for reciprocal movement in a chamber in said tubular body, said chamber having a cylindrical wall extending transversely to said tubular body, said chamber wall having a transverse port for fluid communication to said chamber and wherein said piston comprises a piston head and a piston body of lesser diameter than said piston head, said piston having a central bore extending through said piston, said piston operating to propel said cutting tool outwardly from said tubular body when the force on the face of said piston head exceeds the force on the face of said piston body and to retract said cutting tool when the force of the face of said piston head no longer exceeds the force on the face of said piston body.

16. An undercutter according to claim 15, wherein said fluid operated cutting head includes an annular liner mounted in said chamber between the body of said piston and said chamber wall, said liner cooperating with said chamber port and said piston to set the reciprocating rate of said piston.

17. An undercutter for undercutting the wall of a substantially parallel sided hole, comprising a substantially tubular body adapted to pass into the hole, a fluid operated cutting head, a slide mounting said cutting head on said tubular body for movement transversely of, and for rotation within the hole with said tubular body so as to form an undercut portion in the hole, and activating means for moving said cutting head, said activating means comprising a piston operatively mounted within said cutting head and having a free end engaging the wall of said hole.

* * * * *